US005328793A

United States Patent [19]

Misawa et al.

[11] Patent Number: 5,328,793

[45] Date of Patent: Jul. 12, 1994

[54] MAGNETIC PARTICLES FOR MAGNETIC TONER

[75] Inventors: Hiromitsu Misawa; Kazuo Fujioka; Eiichi Kurita, all of Hiroshima; Yasuhiko Fujii, Ohtake; Yoji Okano, Hiroshima, all of Japan

[73] Assignee: Toda Kogyo Corporation, Hiroshima, Japan

[21] Appl. No.: 959,907

[22] Filed: Oct. 13, 1992

[30] Foreign Application Priority Data

Oct. 30, 1991 [JP] Japan ..... 3-311799

[51] Int. Cl.[5] ..... G03G 9/083

[52] U.S. Cl. ..... 430/106.6

[58] Field of Search ..... 430/106.6, 106

[56] References Cited

U.S. PATENT DOCUMENTS 4,865,834 9/1989 Tanihara et al. ..... 423/634

4,992,191 2/1991 Mori et al. ..... 252/62.59

5,166,027 11/1992 Machida et al. ..... 430/106.6

5,180,650 1/1993 Sacripante et al. ..... 430/106.6

FOREIGN PATENT DOCUMENTS 0187434 3/1985 European Pat. Off. .

0322456 7/1989 European Pat. Off. .

0395026 10/1990 European Pat. Off. .

*Primary Examiner*—John Goodrow

*Attorney, Agent, or Firm*—Nixon & Vanderhye

[57] ABSTRACT

Disclosed herein are magnetic particles for a magnetic toner containing a low-molecular binder resin having a weight-average molecular weight of not more than 150,000, said magnetic particles comprising particulate magnetic particles containing iron as the main ingredient and having an oil absorption of not more than 24 ml/100 g and a degree of compaction of not less than 56, and a magnetic toner containing the said magnetic particles.

11 Claims, 1 Drawing Sheet

MAGNETIC PARTICLES FOR MAGNETIC TONER

BACKGROUND OF THE INVENTION

The present invention relates to magnetic particles for a magnetic toner, and a magnetic toner composed of such magnetic particles. More particularly, the present invention relates to particulate magnetic particles containing iron as the main ingredient, which display an excellent dispersibility when mixed with a low-molecular binder resin, especially, a low-molecular binder resin having a weight-average molecular weight of not more than 150,000, and a magnetic toner composed of such particles.

A development process using, as a developer, composite particles which are produced by mixing and dispersing magnetic particles such as magnetite particles with a resin without using a carrier, in other words, what is called a one component magnetic toner is well known and generally used in the electrostatic latent image development process.

With the recent improvement of the performances of copying machines such as the improvement in copying speed, picture quality, continuous operability and energy saving property, the improvement of the properties of a magnetic toner as a developer has been keenly demanded. For this purpose, magnetic particles which are well mixed with a binder resin are now in strong demand.

This fact is described in Japanese Patent Application Laid-Open (KOKAI) No. 65406/1970 as "Such a one component magnetic powder for a magnetic toner is generally required to have the following properties: ... VII) To be well mixed with a resin. The particle diameter of a toner is ordinarily not more than several 10 μm, and the microscopic mixing degree of a toner is important to the properties of the toner ..."

Various improvements of a binder resin have also been investigated in order to improve the properties a magnetic toner. Aromatic vinyl resins such as styrene resins and vinyl toluene resins, acrylic resins such as acrylic acid resins and methacrylic resins, and copolymer resins of the monomers thereof are conventionally used as a binder resin used for a magnetic toner. These resins are high-molecular binder resins having a weight-average molecular weight of about 300,000.

However, the particle size of a magnetic toner has recently been increasingly reduced in consideration of a high picture quality. In order to obtain a magnetic toner having a small particle size, low-molecular resins having a weight-average molecular weight of not more than 150,000, which are easy to pulverize, have been put to practical use as a binder resin.

From the point of view of the copying-speed accelerating and the improvement of the energy saving property of a copying machine, it is eagerly demanded to use a low-molecular resin which enables a magnetic toner to be heat-fixed to paper at a low temperature and at a high speed, in other words, a resin having a low softening point. This fact is described in Japanese Patent Application Laid-Open (KOKAI) No. 130547/1970 as "Although it is desirable that a heat-fixing developer has a low fixing temperature and an excellent preserving stability, if a resin having a low softening point is used in order to lower the fixing temperature, ..."

Various properties of magnetic particles used for a magnetic toner have also been examined in order to improve the properties of a magnetic toner. For example, in Japanese Patent Application Laid-Open (KOKAI) No. 130547/1970, magnetic particles having an oil absorption of not more than 100 ml/100 g are proposed, and in Japanese Patent Application Laid-Open (KOKAI) No. 24950/1982, magnetic particles having a compressibility of 25 to 38% are proposed. In Japanese Patent Application Laid-Open (KOKAI) No. 182855/1989, magnetic particles having an apparent density of not less than 0.45 g/ml are proposed, and in Japanese Patent Application Laid-Open (KOKAI) No. 80/1990 (corresponds to U.S. Pat No. 5,066,558), magnetic particles having a tap density of 1.2 to 2.5 g/cm$^3$ and an oil absorption of 5 to 30 ml/100 g are proposed.

Although magnetic particles which display an excellent dispersibility when mixed with a low-molecular binder resin having a weight-average molecular weight of not more than 150,000 are now in the strongest demand, as described above, if known magnetic particles are mixed with a low-molecular binder resin having a weight-average molecular weight of not more than 150,000, it is impossible to obtain an adequate dispersibility. It is well known that when known magnetic particles are mixed with a high-molecular binder resin having a weight-average molecular weight of about 300,000, the smaller oil absorption the magnetic particles have, the higher the dispersibility thereof tends to be. On the other hand, when known magnetic particles are mixed with a low-molecular binder resin having a weight-average molecular weight of not more than 150,000, the smaller oil absorption the magnetic particles have, the lower the dispersibility thereof tends to be.

Accordingly, it is an object of the present invention to provide magnetic particles which display an excellent dispersibility even when mixed with a low-molecular binder resin having a weight-average molecular weight of not more than 150,000.

As a result of studies undertaken by the present inventors so as to achieve such purpose, it has been found that particulate magnetic particles containing iron as the main ingredient and having an oil absorption of not more than 24 ml/100 g and a degree of compaction of not less than 56 display an excellent dispersibility even when mixed with a low-molecular binder resin having a weight-average molecular weight of not more than 150,000. On the basis of this finding, the present invention has been achieved.

SUMMARY OF THE INVENTION

In a first aspect of the present invention, there are provided magnetic particles for a magnetic toner containing a low-molecular binder resin having a weight-average molecular weight of not more than 150,000, the magnetic particles comprising particulate magnetic particles containing iron as the main ingredient and having an oil absorption of not more than 24 ml/100 g and a degree of compaction of not less than 56.

In a second aspect of the present invention, there is provided a magnetic toner comprising particulate magnetic particles containing iron as the main ingredient and having an oil absorption of not more than 24 ml/100 g and a degree of compaction of not less than 56, and a low-molecular binder resin having a weight-average molecular weight of not more than 150,000.

DETAILED DESCRIPTION OF THE INVENTION

Figure 1:
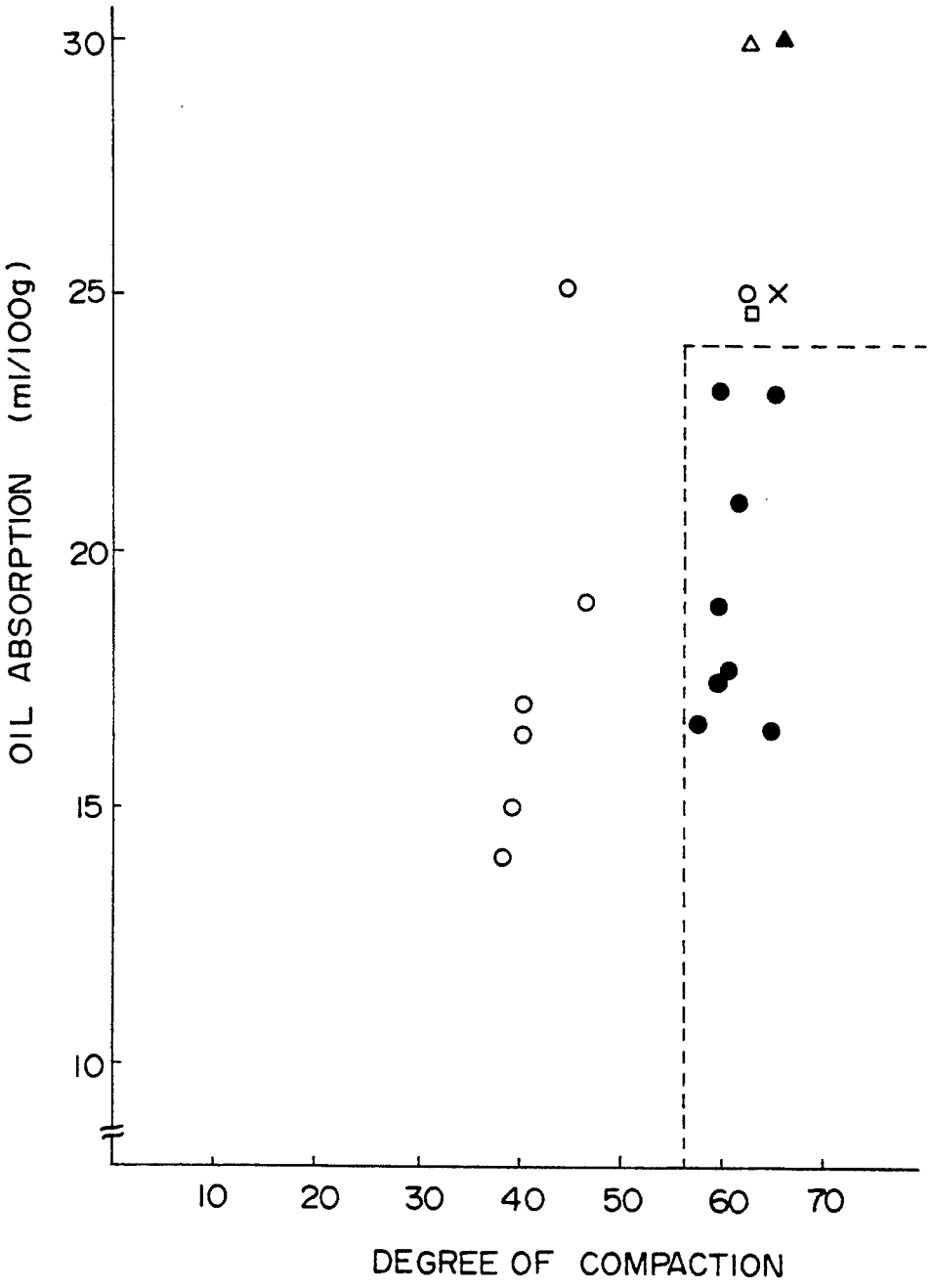
FIG. 1 shows the plotted relationship between the degree of compaction and the oil absorption of magnetic particles for a magnetic toner.

The present invention will be described in more detail hereinunder.

As the binder resin used in the present invention, binder resins which have a weight-average molecular weight of not more than 150,000 and are ordinarily used as a binder resin of the conventional electrophotographic toners, for example, styrene-acryl copolymers, styrene-butadiene copolymer, polystyrene, polyvinyl chloride, phenol resin, epoxy resin, polyester, polyacrylic acid, polyethylene and polypropylene are usable. As one of the concrete examples thereof, styrene-acrylic resin, Himer TB-9000 (produced by Sanyo Chemical Industry Ltd.) (weight-average molecular weight: 110,000) is commercially available.

The magnetic particles according to the present invention are particulate magnetic particles having an oil absorption of not more than 24 ml/100 g and a degree of compaction of not less than 56. If the oil absorption exceeds 24 ml/100 g, the particles are not sufficiently mixed with a binder resin, so that it is difficult to display an excellent dispersibility. If the degree of compaction is less than 56, the compacted particles contained in the magnetic particles when mixed with a low-molecular binder resin having a weight-average molecular weight of not more than 150,000 are difficultly pulverized, so that it is difficult to display an excellent dispersibility.

The degree of compaction in the present invention is represented by the formula:{(tap density−apparent density)/tap density}×100. The smaller the value, the more the compacted particles in the magnetic particles.

As examples of the particulate magnetic particles containing iron as the main ingredient, magnetite particles, maghemite particles, spinel ferrite particles containing at least one selected from the group consisting of zinc, manganese, nickel, cobalt, copper and magnesium, and stable Fe metal particles or Fe based alloy particles which are coated on the surfaces thereof with an oxide(s) layer of Fe or Fe based alloy may be exemplified. The shape of each of the particles is a particulate shape such as a sphere, a hexahedron and an octahedron.

The iron content in the particulate magnetic particles in the present invention is 40 to 80 wt%, preferably 50 to 80 wt%.

The particulate magnetic particles containing iron as the main ingredient, and having an oil absorption of not more than 24 ml/100 g and a degree of compaction of not less than 56, are obtained by the following method.

An oxygen-containing gas is passed into a suspension containing an Fe-containing precipitate such as $Fe(OH)_2$ and $FeCO_3$, which is obtained by the reaction between an aqueous ferrous salt solution and an aqueous alkali solution, or if necessary, a suspension containing an Fe-containing precipitate and other metal, e.g. zinc, manganese, nickel, cobalt, copper and magnesium, which is obtained by adding such metal other than Fe to the Fe-containing suspension, thereby obtaining particulate magnetite particles or particulate spinel ferrite particles. These particles obtained by a wet process are further oxidized, thereby obtaining particulate maghemite, or oxidized and reduced, thereby obtaining particulate high coercive force magnetite particles (Japanese Patent Publication No. 61-1374). Alternatively, an iron material such as iron oxide and other material such as manganese oxide, zinc oxide, nickel oxide, cobalt oxide, copper oxide and magnesium oxide are mixed and heated to obtain particulate spinel ferrite particles, so called a dry process. The above-described particulate magnetite particles, particulate maghemite particles, or particulate spinel ferrite particles are treated by a jet mill, or after treated by a wheel-type kneader, they are treated by an impact pulverizer.

As the jet mill, Jet-O-Mizer, Micronizer, Blaw-Knox, Trost Jet Mill, etc. are usable. A concrete example thereof is commercially available Pneumatic Jet Mill P.J.M-200 (trade name, produced by Nihon Pneumatic Kogyo, K.K.). As the wheel-type kneader, any of Simpson muller mixer, multi-mill, stotz mill, reverse flow kneader and Irich mill may be used. Concrete examples thereof are commercially available Sand Mill MPUV-2 (trade name, produced by Matsumoto Chuzo Tekkosho, K.K.) and Marutimal MSF-15A (trade name, Shinto Kogyo, K.K.). Concrete examples of the impact pulverizer are commercially available Free Pulverizer M-4 (trade name, produced by Nara Kikai Seisakusho, K.K.), Pulverizer AP-1SH (trade name, produced by Hosokawa Micron, K.K.) and Sample mill KII-1 (trade name, produced by Fuji Denki Kogyo, K.K.).

The magnetic particles containing iron as the main ingredient according to the present invention have an oil absorption of not more than 24 ml/100 g, preferably not more than 20 ml/100 g, a degree of compaction of not less than 56, preferably not less than 58, a number-average particle diameter of 0.1 to 1.0 μm, preferably 0.1 to 0.5 μm, a magnetization of not less than 70 emu/g, preferably not less than 75 emu/g, and a coercive force of 10 to 500 Oe , preferably 10 to 300 Oe , more preferably 10 to 200 Oe .

A part of the many experiments carried out by the present inventors will be explained hereinunder.

FIG. 1 shows the plotted relationships between the degrees of compression and the oil absorptions of the magnetic particles according to the present invention, known magnetic particles for a magnetic toner, and the magnetic particles described in Japanese Patent Application Laid-Open (KOKAI) No. 80/1990, respectively. In FIG. 1, the mark ● represents the magnetic particles of the present invention, the mark ○ represents the magnetic particles described in Japanese Patent Application Laid-Open (KOKAI) No. 80/1990, and the marks Δ, ▲, ×, and □ represent commercially available magnetic particles for a magnetic toner, BL-200 (trade name, produced by Titan Kogyo Kabushiki Kaisha), EPT-500 (trade name, produced by Toda Kogyo K.K.). BL-100 (trade name, produced by Titan Kogyo Kabushiki Kaisha) and Mapico Black (trade name, produced by Titan Kogyo Kabushiki Kaisha), respectively.

As is clear from FIG. 1, the oil absorptions and the degrees of compression of the known magnetic particles and the magnetic particles described in Japanese Patent Application Laid-Open (KOKAI) No. 80/1990 are different from those of the magnetic particles of the present invention.

It is considered that the reason why the particulate magnetic particles of the present invention display a more excellent dispersibility than the known magnetic particles and the magnetic particles described in Japanese Patent Application Laid-Open (KOKAI) No. 80/1990 when mixed with a low-molecular binder resin having a weight-average molecular weight of not more than 150,000 is as follows. As shown in FIG. 1, as the oil absorption of the known magnetic particles and the magnetic particles described in Japanese Patent Application Laid-Open (KOKAI) No. 80/1990 are reduced in order to improve the degree of mixing thereof, the degree of compaction thereof is also reduced, so that the amount of the compacted particles in the magnetic particles tends to increase. When magnetic particles containing a large amount of compacted particles are mixed with a high-molecular binder resin having a weight-average molecular weight of about 300,000, the compacted particles are pulverized because the viscosity of the mixture is high enough for the mechanical shear. On the other hand, when such magnetic particles are mixed with a low-molecular binder resin having a weight-average molecular weight of not more than 150,000, the compacted particles are hardly pulverized but be left untouched because the viscosity of the mixture is too low for the mechanical shear. In contrast, since the particulate magnetic particles of the present invention have a large degree of compaction in spite of the small oil absorption, the compacted particles are adequately pulverized by the mechanical shear even if the viscosity of the mixture is low. Consequently, an excellent dispersibility thereof is displayed even when mixed with a low-molecular binder resin having a weight-average molecular weight of not more than 150,000.

A magnetic toner according to the present invention is composed of the above-described particulate magnetic particles containing iron as the main ingredient and having an oil absorption of not more than 24 ml/100 g and a degree of compaction of not less than 56, and a low-molecular binder resin having a weight-average molecular weight of not more than 150,000.

The low-molecular binder resin content in the magnetic toner of the present invention is 20 to 80 wt%, preferably 30 to 70 wt%.

The magnetic toner of the present invention may contain coloring agent, plasticizer, surface lubricant, antistatic agent, etc. in the range which does not deteriorate the dispersibility of the magnetic particles in the low-molecular binder resin.

In producing the magnetic toner of the present invention, known methods (e.g., a method disclosed in Japanese Patent Application Laid-Open (KOKAI) Nos. 80/1990 corresponding to U.S. Pat. No. 5,066,558, and 181757/1990) may be adopted.

The particle diameter of the magnetic toner of the present invention is 3 to 15 μm, preferably 5 to 12 μm.

A glossiness of a resin sheet composed of the magnetic particles of the present invention and the low-molecular binder resin having a weight-average molecular weight of not more than 150,000, is not less than 65% at an angle of incidence of 20°.

Since the magnetic particles of the present invention have an oil absorption of not more than 24 ml/100 g and a degree of compaction of not less than 56, an excellent dispersibility is displayed when mixed with a low-molecular binder resin, especially, a low-molecular binder resin having a weight-average molecular weight of not more than 150,000. These magnetic particles are, therefore, suitable as magnetic particles for a magnetic toner.

EXAMPLES

The present invention will now be explained with reference to the following examples and comparative examples.

The shapes of the particles were observed through a transmission electron microscope and a scanning electron microscope.

The magnetic characteristics of the magnetic particles were measured under an external magnetic field of 10 kOe by a vibration sample magnetometer VSM-3S-15 (produced by Toei Kogyo, K.K.).

A 20-ml graduated measuring cylinder was gradually packed with the magnetic particles by using a funnel after measuring the apparent density thereof, and thereafter the cylinder was dropped naturally from a height of 25 mm. After this dropping operation was repeated 600 times, the volume (ml) of the magnetic particles in the cylinder was read. The obtained volume (ml) was inserted into the following formula, and the value obtained was expressed as the tap density.

$$\text{Tap density (g/ml)} = 10\ \text{g/volume (ml)}$$

The apparent density (g/ml) and the oil absorption were measured in accordance with JIS K 5101.

The glossiness of the surface of the resin film was measured at an angle of incidence of 20° by a glossmeter UGV-50 (trade name, produced by Suga Shikenki, K.K.). The angle of incidence for measuring the glossiness was determined to be 20° because as the angle of incidence becomes smaller, it is possible to sense minuter projections and depressions on the surface of the resin film and to judge the degree of dispersibility more clearly.

EXAMPLE 1

Spherical magnetite particles having an oil absorption of 22 ml/100 g, a degree of compaction of 55 and a number-average particle diameter of 0 22 μm (magnetization: 83.5 emu/g, coercive force: 55 Oe) were produced in an aqueous solution by a wet process. 10 kg of the magnetite particles were charged into a Simpson mix muller, Sand Mill MPUV-2 (trade name, produced by Matsumoto Chuzo Tekkosho K.K.), and were treated for 30 minutes.

10 kg of the particles treated by the sand mill were then charged into a Sample Mill KII-1 (trade name, produced by Fuji Denki Kogyo, K.K.) and treated.

The thus-treated particles were spherical magnetite particles having an oil absorption of 16.5 ml/100 g, a degree of compaction of 58 and a number-average diameter of 0.22 μm (magnetization: 83.1 emu/g, coercive force: 55 Oe).

15 g of the thus-treated particles were kneaded with 34 g of styrene-acrylic resin, Himer TB-9000 (trade name, produced by Sanyo Chemical Industry Ltd.) (weight-average molecular weight: 110,000) which had been dried at 60° C. for 8 hours in advance, and 1 g of polypropylene resin, Viscol 550P (trade name, produced by Sanyo Chemical Industry Ltd.) as a surface lubricant for 5 minutes by a hot roll having a surface temperature of 130° C. The thus-kneaded product was heat-pressed into a sheet. The glossiness of the sheet was 73.9% at an angle of incidence of 20°.

The main manufacturing conditions and the properties of the product are shown in Table 1. The glossiness of the sheet obtained by using high-molecular resin, Himer TB-1000 (trade name, produced by Sanyo Chemical Industry Ltd.) (weight-average molecular weight: 300,000) instead of the styrene-acrylic resin, Himer TB-9000 is also shown for reference.

50 g of the thus-treated particles were kneaded with 90 g of styrene-acrylic resin, Himer TB-9000 (trade name, produced by Sanyo Chemical Industry Ltd.) (weight-average molecular weight: 110,000) which had been dried at 60° C. for 8 hours in advance, 2 g of polypropylene resin, Viscol 550P (trade name, produced by Sanyo Chemical Industry Ltd.) as a surface lubricant, 0.5 g chromium complex of monoazo dye (Bonton S-34, produced by Orient Chemical K.K.) as a charge control agent for 5 minutes by a hot roll having a surface temperature of 130° C.

A magnetic toner was produced from the thus-kneaded product in accordance with the method described in Japanese Patent Application Laid-Open (KOKAI) No. 80/1990.

EXAMPLES 2 TO 5 AND COMPARATIVE EXAMPLES 1 TO 7

Magnetic particles were obtained in the same way as in Example 1 except that the kind of the particles being treated, the kind of the machine in the mechanical treatment and the order of treatment were varied. The main manufacturing conditions and the properties of the products are shown in Table 1.

TABLE 1

| Examples & Comparative Examples | Kind of particles to be treated | Mechanical treatment Kind of machine | Mechanical treatment Kind of machine | Particulate magnetic particles containing iron as the main ingredient: Number-average particle diameter (μm) | Oil absorption (ml/100 g) | Degree of compaction | Magnetization (emu/g) | Coercive force (Oe) | Glossiness of the surface of resin film: Himer TB-9000 (molecular weight: 110,000) Angle of incidence 20° (%) | Himer TB-1000 (molecular weight: 300,000) Angle of incidence 20° (%) |
|---|---|---|---|---|---|---|---|---|---|---|
| Example 1 | Spherical magnetite particles produced in an aqueous solution (Oil absorption: 22.0 ml/100 g, Degree of compaction: 55, Average particle diameter: 0.22 μm, Magnetization: 83.5 emu/g Coercive force: 55 Oe) | Sand Mill MPUV-2 (Matsumoto Chuzo Tekkosho K.K.) | Sample Mill KII-1 (Fuji Denki Kogyo K.K.) | 0.22 | 16.5 | 58 | 83.1 | 55 | 73.9 | 49.3 |
| Example 2 | Octahedral magnetite particles produced in an aqueous solution (Oil absorption: 32.0 ml/100 g, Degree of compaction: 65, Average particle diameter: 0.17 μm, Magnetization: 82.5 emu/g Coercive force: 35 Oe) | Sand Mill MPUV-2 (Matsumoto Chuzo Tekkosho K.K.) | Sample Mill KII-1 (Fuji Denki Kogyo (K.K.) | 0.17 | 23.2 | 60 | 82.1 | 130 | 65.1 | 45.2 |
| Example 3 | Hexahedral magnetite particles produced in an aqueous solution (Oil absorption: 26.0 ml/100 g, Degree of compaction: 59, Average particle diameter: 0.20 μm, Magnetization: 83.3 emu/g Coercive force: 95 Oe) | Sand Mill MPUV-2 (Matsumoto Chuzo Tekkosho K.K.) | Sample Mill KII-1 (Fuji Denki Kogyo K.K.) | 0.20 | 18.0 | 60 | 82.5 | 90 | 70.1 | 47.5 |
| Example 4 | Same magnetic particle as in Example 1 | Marutimal MSF-15A (Shinto Kogyo K.K.) | Pulverizer AP-1SH (Hosokawa Micron K.K.) | 0.22 | 17.5 | 61 | 82.9 | 54 | 72.1 | 49.0 |
| Example 5 | Same magnetic particle as in Example 1 | Pneumatic Jet Mill PJM-200 (Nihon Pneumatic Kogyo K.K.) | — | 0.22 | 17.0 | 60 | 83.2 | 53 | 72.5 | 49.5 |
| Comp. Example 1 | Same magnetic particle as in Example 1 | Sample Mill KII-1 (Fuji Denki Kogyo K.K.) | Sand Mill MPUV-2 (Matsumoto Chuzo Tekkosho K.K.) | 0.22 | 16.0 | 45 | 83.0 | 53 | 64.1 | 50.0 |

TABLE 1-continued

| Examples & Comparative Examples | Kind of particles to be treated | Mechanical treatment Kind of machine | Mechanical treatment Kind of machine | Particulate magnetic particles containing iron as the main ingredient: Number-average particle diameter (μm) | Oil absorption (ml/100 g) | Degree of compaction | Magnetization (emu/g) | Coercive force (Oe) | Glossiness of the surface of resin film: Himer TB-9000 (molecular weight: 110,000) Angle of incidence 20° (%) | Himer TB-1000 (molecular weight: 300,000) Angle of incidence 20° (%) |
|---|---|---|---|---|---|---|---|---|---|---|
| Comp. Example 2 | Same magnetic particle as in Example 1 | Sample Mill KII-1 (Fuji Denki Kogyo K.K.) | — | 0.22 | 21.0 | 55 | 83.2 | 56 | 55.4 | 37.3 |
| Comp. Example 3 | Same magnetic particle as in Example 1 | Sand Mill MPUV-2 (Matsumoto Chuzo Tekkosho K.K.) | — | 0.22 | 16.0 | 44 | 83.1 | 53 | 63.7 | 49.5 |
| Comp. Example 4 | Same magnetic particle as in Example 2 | Sample Mill KII-1 (Fuji Denki Kogyo K.K.) | Sand Mill MPUV-2 (Matsumoto Chuzo Tekkosho K.K.) | 0.17 | 23.0 | 51 | 82.1 | 129 | 57.1 | 45.5 |
| Comp. Example 5 | Same magnetic particle as in Example 2 | Sample Mill KII-1 (Fuji Denki Kogyo K.K.) | — | 0.17 | 31.0 | 64 | 82.2 | 138 | 50.1 | 35.1 |
| Comp. Example 6 | Same magnetic particle as in Example 2 | Sand Mill MPUV-2 (Matsumoto Chuzo Tekkosho K.K.) | — | 0.17 | 22.0 | 50 | 81.9 | 130 | 56.5 | 46.0 |
| Comp. Example 7 | Same magnetic particle as in Example 3 | Sand Mill MPUV-2 (Matsumoto Chuzo Tekkosho K.K.) | — | 0.20 | 18.2 | 47 | 83.0 | 88 | 60.3 | 48.1 |

What is claimed is:

1. Magnetic particles for a magnetic toner comprising particulate magnetic particles containing iron as the main ingredient and having an oil absorption of not more than 24 ml/100 g and a degree of compaction of not less than 56, and a low-molecular weight binder resin having a weight-average molecular weight of not more than 150,000.

2. Magnetic particles according to claim 1, wherein the iron content in said particulate magnetic particles is 40 to 80 wt%.

3. Magnetic particles according to claim 1, wherein the number-average particle diameter of said particulate magnetic particles is 0.1 to 1.0 μm.

4. Magnetic particles according to claim 1, wherein said particulate magnetic particles are magnetite particles, maghemite particles, spinel ferrite particles containing at least one selected from the group consisting of Zn, Mn, Ni, Co, Cu and Mg, or stable Fe metal particles or Fe based alloy particles which are coated on the surfaces thereof with an oxide(s) layer of Fe or Fe based alloy.

5. A magnetic toner comprising magnetic composed of particulate magnetic particles containing iron as the main ingredient and having an oil absorption of not more than 24 ml/100 g and a degree of compaction of not less than 56, and a low-molecular weight binder resin having a weight-average molecular weight of not more than 150,000.

6. A magnetic toner according to claim 5, wherein the low-molecular binder resin content is not less than 20 to 80 wt% .

7. A magnetic toner according to claim 5, wherein the iron content in said particulate magnetic particles is not 40 to 80 wt%.

8. A magnetic toner according to claim 5, wherein the number-average particle diameter of said particulate magnetic particles is 0.1 to 1.0 μm.

9. A magnetic toner according to claim 5, wherein said particulate magnetic particles are magnetite particles, maghemite particles, spinel ferrite particles containing at least one selected from the group consisting of Zn, Mn, Ni, Co, Cu and Mg, or stable Fe metal particles or Fe based alloy particles which are coated on the surfaces thereof with an oxide (s) layer of Fe or Fe based alloy.

10. A magnetic toner according to claim 5, wherein said low-molecular binder resin is one selected from a group consisting of a styrene-acrylic copolymer, styrene-butadiene copolymer, polystyrene, polyvinyl chloride, phenol resin, epoxy resin, polyester, polyacrylic acid, polyethylene and polypropylene.

11. A magnetic toner according to claim 5, wherein the average particle diameter thereof is 5 to 15 $\mu$m.

* * * * *

UNITED STATES PATENT AND TRADEMARK OFFICE

CERTIFICATE OF CORRECTION

PATENT NO. : 5,328,793
DATED : July 12, 1994
INVENTOR(S) : MISAWA et al

It is certified that error appears in the above-indentified patent and that said Letters Patent is hereby corrected as shown below:

Column 10, line 51, after "magnetic" insert --particles--.

Signed and Sealed this

Fourth Day of October, 1994

*Attest:*

*Attesting Officer*

BRUCE LEHMAN

*Commissioner of Patents and Trademarks*